US008592123B2

(12) United States Patent
Yamada et al.

(10) Patent No.: US 8,592,123 B2
(45) Date of Patent: Nov. 26, 2013

(54) CARRIER CORE MATERIAL FOR ELECTROPHOTOGRAPHIC DEVELOPER, AND MANUFACTURING METHOD OF THE SAME, CARRIER FOR ELECTROPHOTOGRAPHIC DEVELOPER, AND ELECTROPHOTOGRAPHIC DEVELOPER

(75) Inventors: Tomoya Yamada, Okayama (JP); Takashi Fujiwara, Okayama (JP); Ryusuke Nakao, Okayama (JP); Yukihiro Matuda, Okayama (JP); Tomokazu Mouri, Okayama (JP)

(73) Assignees: Dowa Electronics Materials Co., Ltd., Tokyo (JP); Dowa IP Creation Co., Ltd., Okayama (JP)

( * ) Notice: Subject to any disclaimer, the term of this patent is extended or adjusted under 35 U.S.C. 154(b) by 712 days.

(21) Appl. No.: 12/450,321

(22) PCT Filed: Apr. 9, 2008

(86) PCT No.: PCT/JP2008/057025

§ 371 (c)(1),
(2), (4) Date: Nov. 23, 2009

(87) PCT Pub. No.: WO2008/126869

PCT Pub. Date: Oct. 23, 2008

(65) Prior Publication Data

US 2010/0075244 A1 Mar. 25, 2010

(30) Foreign Application Priority Data

Apr. 10, 2007 (JP) ..... 2007-103290

(51) Int. Cl.
*G03G 9/113* (2006.01)

(52) U.S. Cl.
USPC ..... 430/111.33; 430/111.32; 430/111.41

(58) Field of Classification Search
USPC ..... 430/111.32, 111.33, 111.41
See application file for complete search history.

(56) References Cited

U.S. PATENT DOCUMENTS

2007/0141502 A1 6/2007 Aga et al.
2009/0258311 A1* 10/2009 Nakao et al. ..... 430/111.31

FOREIGN PATENT DOCUMENTS

EP 1729181 A1 * 12/2006
EP 1 990 684 A1 11/2008
JP A 2001-93720 4/2001
JP A 2002-296846 10/2002
JP A 2006-38961 2/2006
JP A 2006-323211 11/2006

(Continued)

OTHER PUBLICATIONS

English language machine translation of JP 2007-034249 (Feb. 2007).*

(Continued)

*Primary Examiner* — Christopher Rodee
(74) *Attorney, Agent, or Firm* — Oliff & Berridge, PLC

(57) ABSTRACT

To provide a carrier for electrophotographic developer, capable of realizing a high image quality and full colorization and reducing carrier scattering, and a manufacturing method of the same, and an electrophotographic developer containing the carrier. A carrier core material for electrophotographic developer, with a general formula expressed by $Mg_xMn_{(1-x)}Fe_yO_4$ (where $0<x<1$, and $1.6\leq y\leq 2.4$), wherein a half-value width B of a peak having a maximum intensity in a powder XRD pattern satisfies $B\leq 0.180$ (degree), is manufactured and from this carrier core material for electrophotographic developer, the carrier for electrophotographic developer and the electrophotographic developer are manufactured.

6 Claims, 2 Drawing Sheets

(56) References Cited

FOREIGN PATENT DOCUMENTS

JP A 2006-337828 12/2006
JP 2007034249 A * 2/2007
WO WO 2007037182 A1 * 4/2007

OTHER PUBLICATIONS

Search Report issued May 28, 2010 in European Patent Application No. EP 08 74 0128.7.

* cited by examiner

CARRIER CORE MATERIAL FOR ELECTROPHOTOGRAPHIC DEVELOPER, AND MANUFACTURING METHOD OF THE SAME, CARRIER FOR ELECTROPHOTOGRAPHIC DEVELOPER, AND ELECTROPHOTOGRAPHIC DEVELOPER

TECHNICAL FIELD

The present invention relates to a carrier core material for electrophotographic developer used in a carrier for two-component electrophotographic developer used as a mixture with toner in a two-component electrophotographic developer and a manufacturing method of the same, a carrier for electrophotographic developer, and an electrophotographic developer.

DESCRIPTION OF RELATED ART

In recent years, as a wide spread of apparatuses using an electrophotographic system, such as copiers and printers, those apparatuses are being put to a variety of uses. In the market, regarding the electrophotography, a demand for higher image quality is increasing, and regarding electrophotographic developers, a long service life is required.

Conventionally, in two-component electrophotographic developers, it has been considered that high image quality of electrophotography can be achieved by reducing the particle size of the toner in use. However, accompanying with a smaller size of a toner particle, electric charging capability of the toner particle is lowered. In order to cope with lowering of the electric charging capability of the toner particle, a countermeasure such as making a carrier particle smaller, (described as a "carrier" hereinafter) used as a mixture with the toner in the two-component electrophotographic developer, and enlarging a specific surface area, is taken. However, there is a problem that a carrier, with its particle size reduced, easily allows an abnormal phenomenon to occur, such as adhesion and scattering of the carrier.

Here, carrier adhesion is a phenomenon in which a carrier used in an electrophotographic developer scatters during the electrophotographic development process and adheres to the photoreceptor or other development apparatus.

In a development apparatus, the carrier is prevented from scattering by an existence of a magnetic force and an electrostatic force to let the carrier hold on the development sleeve against a centrifugal force, added to the carrier by rotation of the development sleeve. However, in the carrier, with its particle size reduced, according to a related art, the centrifugal force obtained by the rotation of the development sleeve is greater than the holding force. Consequently, a phenomenon (carrier adhesion) occurs in which the carrier scatters from the magnetic brush and adheres to the photoreceptor. The carrier adhered to the photoreceptor sometimes unfavorably reaches the transfer unit. In a state that the carrier is adhered to the photoreceptor, a toner image around the carrier is not transferred to transfer paper, thereby causing image abnormality.

Conventionally, when the carrier with small particle size is used, carrier scattering is generally considered to occur mainly by the carrier with particle size smaller than 22 μm. Therefore, by taking a measure such that the content of the carrier having particle size smaller than 22 μm is set to be less than 1 wt % of the electrophotographic developer, it can be so considered that the carrier scattering can be prevented.

From the aforementioned viewpoint, for example, Patent Document 1 proposes a carrier, with a volume average particle size of core material particles set to be 25 μm to 45 μm, an average void diameter set to be 10 μm to 20 μm, proportion of particles having 22 μm or smaller particle size set to be less than 1%, magnetization in a magnetic field 1000 Oe set to be 67 emu/g-88 emu/g, and a difference between magnetization of scattered materials and that of a main body set to be 10 emu/g or smaller.

Patent Document 1: Japanese Patent Laid Open Publication No. 2002-296846

DISCLOSURE OF INVENTION

Problems to be Solved by the Invention

However, as a result of study by the inventors of the present invention, even if a carrier which is the same level as the one described in Patent Document 1 is used, it is not possible to completely prevent the occurrence of carrier scattering.

Under the aforementioned circumstances, the present invention is provided, and an object of the present invention is to provide a carrier for electrophotographic developer capable of realizing a high image quality and full colorization and simultaneously capable of reducing scattering, and a manufacturing method of the same, and the electrophotographic developer including this carrier.

Means for Solving the Problem

After a strenuous effort by the inventors of the present invention, regarding a cause for generating the aforementioned carrier scattering when the carrier with small particle size according to the conventional art is used, a first knowledge is that the carrier with low magnetic susceptibility that exists in the carrier (described as "low magnetic susceptibility particle" hereinafter) causes the carrier scattering to occur.

Further, a second knowledge is that when the magnetic susceptibility of the carrier is high beyond a prescribed value, a magnetic brush formed in a developing device becomes excessively hard, and therefore excellent image characteristics can not be obtained.

According to the aforementioned cause of the carrier scattering based on the first knowledge, due to the existence of low magnetic susceptibility particles in the carrier, the holding force among particles around the low magnetic susceptibility particles becomes locally weak in a magnetic brush formed by the carrier. Because the holding force among carriers (particles) becomes weak, carrier scattering occurs in this weakened portion. Therefore, the amount of carrier scattering increases in proportion to the increase in the existence ratio of the low magnetic susceptibility particles contained in the carrier.

Moreover, magnetic susceptibility described in the present invention is expressed, unless otherwise specified, by $\sigma_{1000}$ (unit: emu/g) which is a magnetic susceptibility in an external magnetic field 1000 Oe, and a low magnetic susceptibility particles are particles satisfying $\sigma_{1000}<15$ emu/g.

Based on the above-mentioned first knowledge, the inventors of the present invention perform study on the reduction of the existence ratio of the low magnetic susceptibility particles in the carrier, to prevent the carrier from scattering.

However, according to the study by the inventors of the present invention, the existence ratio of the low magnetic susceptibility particles in the carrier is extremely low, such as several hundred ppm or less, even in cases where serious carrier scattering occurs. Therefore, it is found that the existence ratio of the low magnetic susceptibility particles cannot be measured correctly by ordinary screening methods such as a magnetic screening method.

Therefore, in evaluating the existence ratio of the low magnetic susceptibility particles, the inventors of the present invention focus on a half-value width of a peak in a carrier's powder X-ray diffraction (XRD) pattern and obtains a knowledge that as the half-value width of the carrier becomes narrower, the existence ratio of the low magnetic susceptibility particles becomes lower, and thus, carrier scattering can be prevented.

Here, a further explanation will be given for the knowledge that the carrier scattering can be prevented in a case of the carrier having narrower half-value width.

The cause for the existence of the low magnetic susceptibility particles in the carrier is the occurrence of the particle having a composition significantly different from that of a general population of the carrier due to some reason caused during a manufacturing process. This particle has the same crystalline structure as that of the general population of the carrier but has a different composition. Therefore, a lattice constant is changed. As a result, although the powder XRD pattern of the low magnetic susceptibility particles is similar to the powder XRD pattern of the general population of the carrier, the peak position is slightly deviated. Therefore, the powder XRD pattern of the carrier, in which low magnetic susceptibility particles are mixed, is formed in a pattern having a broader peak in which a plurality of slightly deviated XRD patterns are overlapped on one another. On the contrary, it can be said that as a peak width in the XRD pattern of the carrier becomes narrower, the existence ratio of the low magnetic susceptibility particles is small.

As a result of further study by the inventors of the present invention, it is confirmed that such a deviation of a peak position occurs not only due to deviation in the composition but also due to excess oxidation of the carrier, thereby causing the peak in the XRD pattern to become broad. Needless to say, the excess oxidation of the carrier is also a cause of the generation of the low magnetic susceptibility particles.

Based on the aforementioned knowledge, study on reducing the existence ratio of the low magnetic susceptibility particles in the carrier is performed by the inventors of the present invention, for the purpose of suppressing the carrier scattering.

However, according to the study by the inventors of the present invention, the existence ratio in the carrier of the low magnetic susceptibility particles is several hundreds ppm or less and is extremely small, even when serious carrier scattering occurs. Therefore, in the normal screening method such as a magnetic screening method, it is found that the existence ratio of the low magnetic susceptibility particles cannot be accurately measured.

Therefore, when the existence ratio of the low magnetic susceptibility particles is evaluated, the inventors of the present invention focus on a half-value width of the peak in the powder X-ray diffraction (XRD) pattern and obtain a knowledge that as the half-value width of the carrier becomes narrower, the existence ratio of the law magnetic susceptibility particles becomes lower, and thus, carrier scattering can be prevented.

Here, explanation will be further given for the knowledge that the carrier scattering can be prevented in a case of the carrier having narrower half-value width. The cause for the existence of the low magnetic susceptibility particles in the carrier is the occurrence of the particle having a composition significantly different from that of the general population of the carrier due to some reason caused during the manufacturing process. This particle has the same crystalline structure as that of the general population of the carrier but has a different composition. Therefore, the lattice constant is changed. As a result, although the powder XRD pattern of the low magnetic susceptibility particle is similar to the powder XRD pattern of the general population of the carrier, the peak position is slightly deviated. Accordingly, the powder XRD pattern of the carrier, in which low magnetic susceptibility particles are mixed, is formed in a pattern having a broader peak in which a plurality of slightly deviated XRD patterns are overlapped on one another. On the contrary, it can be said that as the peak width in the XRD pattern of the carrier becomes narrower, the existence ratio of the low magnetic susceptibility particles becomes small.

As a result of further study by the inventors of the present invention, it is confirmed that such a deviation of the peak position occurs not only due to deviation in the composition but also due to excess oxidation of the carrier, thereby causing the peak in the XRD pattern to become broad. Needless to say, the excess oxidation of the carrier is also the cause of the generation of the low magnetic susceptibility particles.

As described above, by the inventors of the present invention, it is found that the carrier, with the carrier scattering suppressed, can be defined by using the half-value width of the peak in the powder XRD pattern, and further a manufacturing method is found, capable of manufacturing the magnetic powders, wherein the half-value width of the peak in the powder XRD pattern is defined.

Next, based on the second knowledge, the inventors of the present invention make a strenuous effort to study on solving the problem that excellent image characteristics can not be obtained, because the aforementioned magnetic brush is excessively hard. As a result, the inventors achieve a point that the magnetic susceptibility of the carrier in the external magnetic field 1000 Oe may be set to 65 emu/g or less. However, it is also found that when a conventional method of making oxygen concentration of atmosphere high, or making a sintering temperature low is used, in the step of obtaining the carrier core material by sintering the mixture of raw material powders, as a means for lowering the magnetic susceptibility, variation of the particle size of the obtained carrier core material is increased, thus further promoting the carrier scattering.

Here, it is found by the inventors of the present invention that when Mn ferrite added with prescribed amount of Mg is used, it is possible to stably obtain the carrier, with magnetic susceptibility in the external magnetic field 1000 Oe set to be 65 emu/g or less, and without depending on a sintering atmosphere and a sintering temperature.

As a result, it is found by the inventors of the present invention that high image quality and full colorization are achieved, and simultaneously the carrier for electrophotographic developer, with carrier scattering reduced, can be manufactured. The present invention is thus completed.

Namely, first means for solving the problem provides a carrier core material for electrophotographic developer expressed by a general formula $Mg_xMn_{(1-x)}Fe_yO_4$ (where $0<x<1$, and $1.6\leq y\leq 2.4$), wherein a half-value width B of a peak having a maximum intensity in a powder XRD pattern satisfies $B\leq 0.180$ (degree).

Second means provides the carrier core material for electrophotographic developer described in the first means, wherein a general formula is expressed by $Mg_xMn_{(1-x)}Fe_yO_4$ (where $0<x\leq 0.8$, and $1.6\leq y\leq 2.4$).

Third means provides the carrier for electrophotographic developer according to the first means or the second means, wherein magnetic susceptibility $\sigma_{1000}$ in an external magnetic field 1000 Oe satisfies 15 emu/g$\leq\sigma_{1000}\leq$65 emu/g.

Fourth means provides the carrier for electrophotographic developer according to any one of the first to third means, wherein an average particle size is 10 μm or more and 80 μm or less.

Fifth means provides a method for manufacturing a carrier core material for electrophotographic developer including the steps of:

preparing Fe raw material powders, Mn raw material powders, and Mg raw material powders, then dividing the whole volume of particles into each particle size, and obtaining a cumulative curve of a volume in each particle size from the side of a small particle side, with the whole volume of the particles set as 100%, and making the particles finer so that a value of D90 is set to be 1.0 μm or less when the particle size at cumulative curve of 90% is expressed by D90;

turning the obtained fine particles into slurry by stirring the powders in a medium solution;

obtaining granulated powders by drying and granulating the obtained slurry;

obtaining a sintered material having a magnetic phase by sintering the obtained granulated powders; and turning the obtained sintered material into powders by applying pulverization process thereto, to have a prescribed particle size distribution thereafter.

Sixth means provides the carrier for electrophotographic developer, wherein the carrier core material according to any one of the first to fourth means is coated with resin.

Seventh means provides an electrophotographic developer, including the carrier for electrophotographic developer according to the sixth means and toner.

Advantages of the Invention

According to the present invention, it is possible to provide a carrier for electrophotographic developer and an electrophotographic developer capable of significantly reducing scattering of a carrier in a developing machine when used as an electrophotographic developer for copiers, printers, and the like.

BEST MODE FOR CARRYING OUT THE INVENTION

Hereafter, the present invention will be described in sequential order of (1) a carrier core material for electrophotographic developer, (2) a method for manufacturing a carrier core material for electrophotographic developer, (3) a carrier for electrophotographic developer, and (4) an electrophotographic developer.

1. Carrier Core Material for Electrophotographic Developer

<Composition>

$Mn_xFe_{3-x}O_4$ (satisfying $0<x<1$, $1.6\leq y\leq 2.4$), and further preferably ($0<x\leq 0.8$, $1.6\leq y\leq 2.4$), being soft ferrite, is used as a substance, becoming the carrier core material constituting the carrier of the present invention. This is because the substance expressed by the aforementioned composition formula makes it possible to have the magnetic susceptibility of 65 emu/g or less of the carrier in the external magnetic field 1000 Oe, without controlling the oxygen concentration of the atmosphere by adjusting values of x, y, or without using the means involving the generation of characteristic variation of the particles such as lowering the sintering temperature, and further makes it possible to adjust powder characteristics such as apparent densities or fluidity. In addition, as a result of further study by the inventors of the present invention, it is confirmed that the magnetic phase expressed by this composition formula has a high stability even in a state of high oxygen concentration (for example, in an atmospheric air), and the generation of the low magnetic susceptibility particles due to excess oxidation can be suppressed, in the step of sintering.

<Powder XRD Pattern>

The carrier core material for electrophotographic developer according to the present invention has a half-value width B of the maximum peak of the substance, becoming the core material, satisfying $B\leq 0.180$ (degree) in the powder XRD pattern. This shows that, as described above, the narrower the half-value width of the material is, the less the existence ratio of the low magnetic susceptibility particles are. Further, when the value of B satisfies this relation, the carrier scattering is extremely lessened.

<Particle Size>

In the particle size distribution of the carrier core material for electrophotographic developer of the present invention, the average particle size is preferably set to be 10 μm or more and 80 μm or less. This is because when the particle size is in this range or more, the image characteristics are deteriorated, and reversely when the particle size is too small, a magnetic force per one particle is lowered and the carrier scattering can be hardly suppressed.

Preferably, classification processing is performed by shifter, etc, during or after the manufacturing step, so as to have the aforementioned particle size distribution.

2. Manufacturing Method of the Carrier Core Material for Electrophotographic Developer Generally, the magnetic powders used as the carrier core material for electrophotographic developer are manufactured through the steps of mixing powders that become raw materials, then adding binder, etc, thereto, and granulating the powders up to a proper particle size, and thereafter obtaining a magnetic phase by sintering.

After strenuous efforts in studying on a method for manufacturing magnetic powders having narrow half-value width in the peak of the powder XRD pattern, the inventors of the present invention obtains a knowledge that it is effective that powders, becoming raw materials, are made finer in advance, and these raw material powders are sufficiently mixed.

The generation of low magnetic susceptibility particles can be prevented by sufficiently mixing the raw material particles in the mixing and granulating process to thereby homogenize the composition of each particle, as an effect of making raw material powders finer and as an effect of sufficiently mixing the raw material powders.

The manufacturing method of the carrier core material for electrophotographic developer will be described hereinafter in detail, in every steps.

<Raw Materials>

A simple substance of a constitution of the magnetic phase, being a target, or each kind of oxide or carbonate compound is used as the raw materials.

If a spinel-type ferrite of a composition expressed by $Mg_xMn_{(1-x)}Fe_yO_4$ is generated, metals Fe, $Fe_3O_4$, $Fe_2O_3$ are suitably used as a Fe supply source, and metals Mn, $MnO_2$, $Mn_2O_3$, $Mn_3O_4$, and $MnCO_3$ are suitably used as a Mg supply source, and metals Mg, MgO, $MgCO_3$, and Mg $(OH)_2$ are suitably used as a Mg supply source. Each raw material is weighed and mixed, so that a mixing ratio of Fe, Mn, and Mg after sintering reaches a target composition.

It is desirable that the particle of each raw material is made finer so that the average particle size is set to be 1.0 μm or less in a stage of not being granulated, such as a dry state. Particularly, in order to manufacture the magnetic powders of the present invention, it is important that almost no particle of 1.0 μm or more is contained in the raw material powders.

Specifically, when the whole volume of the particles is divided into each particle size and the cumulative curve of the volume in each particle size is obtained from the side of the small particle size, with the whole volume of the powder set as 100%, the value of D90 is desired to be 1.01 μm or less, when the particle size at cumulative curve of 90% is expressed by D90.

In order to obtain the aforementioned fine raw materials, the particle size is adjusted by applying pulverization processing to the raw material powders by a ball mill and a jet mill. The pulverization processing may be performed in a stage before mixing each raw material powder, or may be performed in a stage after mixing each raw material powder so as to be a target composition. By using the aforementioned fine raw material powders with average particle size of 1.0 μm or less, each particle composition manufactured in the mixing/granulating step becomes homogeneous, and the magnetic powders with narrow half-value width of the peak in the powder XRD pattern can be manufactured.

<Mixing/Slurrying>

After the aforementioned raw materials are measured so as to be a prescribed composition ratio, the raw material powders thus made to be finer are turned into slurry by stirring them in the medium solution. The mixing ratio of the raw material powders and the medium solution is desirably set, so that the concentration of a solid portion of the slurry occupies 50 to 90 mass %. The medium solution obtained by adding binder and dispersant to water is prepared. As the binder, for example, polyvinyl alcohol can be suitably used, and the concentration in the medium solution may be set to be about 0.5 to 2 mass %. As the dispersant, for example, polycarboxyl ammonium-based one can be suitably used, and its concentration in the medium solution may also be set to be about 0.5 to 2 mass %. In addition, phosphorus and boric acid, etc, can be added as a lubricant agent and a sintering accelerator.

Here, each raw material can be slurried by being stirred in a vessel. However, when each raw material is thus slurried, pulverization processing is preferably added by a wet-type ball mill. This is because by adding the pulverization processing using the wet-type ball mill, powders can be made finer simultaneously with mixing of the raw materials.

<Granulation>

Granulation can be suitably performed by introducing the raw materials thus slurried to a spray drier. An atmosphere temperature at the time of performing spray-drying may be set to be about 100 to 300° C. Thus, granulated powders, with particle size set to be about 10 to 200 μm, can be obtained. The particle size of the obtained granulated powder is desirably adjusted by removing excessively large particle of the granulated powders, such as the particle having particle size exceeding 100 μm, by using a vibration screen, etc, in consideration of a final particle size as a product.

<Sintering>

Next, the granulated powders are charged into a heated furnace, to thereby obtain the sintered material having the magnetic phase. The sintering temperature may be set to a temperature range of generating a target magnetic phase. However, when the soft ferrite $Mg_xMn_{(1-x)}Fe_{3-x}O_4$ is manufactured, sintering is generally performed in a temperature range of 1000 to 1300° C.

The atmosphere during sintering may be adjusted to be a range of generating a target magnetic phase at the sintering temperature. Generally, atmospheric air or low oxygen atmosphere formed by flowing inactive gas can be used.

Pulverization processing is applied to the obtained sintered material by using a hammer mill or a ball mill, etc, to thereby turn it into powders, and thereafter by performing classification using shifter, a target particle size distribution is provided. Thus, the carrier core material for electrophotographic developer according to the present invention can be obtained.

3. Carrier for Electrophotographic Developer

The carrier core material for electrophotographic developer according to the present invention can be coated with silicone-based resin, etc, and the carrier for electrophotographic developer can be obtained by imparting chargeability and improving durability. A coating method using the silicone-based resin may be performed by a publicly-known technique.

4. Electrophotographic Developer

By mixing the carrier for electrophotographic developer of the present invention with a suitable toner, the electrophotographic developer according to the present invention can be obtained.

EXAMPLES

The present invention will be specifically described based on examples given hereinafter.

Example 1

$Fe_2O_3$(average particle size: 0.6 μm) 7.6 kg, $Mn_3O_4$(average particle size: 0.9 μm) 1.1 kg, and MgO (average particle size: 0.8 μm) 1.3 kg were dispersed into pure water 3.0 kg, then polycarboxyl ammonium-based dispersant 60 g was added as a dispersant, to thereby obtain a mixture. This mixture was subjected to pulverization processing by using the wet-type ball mill (media diameter 2 mm), to thereby obtain a mixed slurry of $Fe_2O_3$, $Mn_3O_4$, and MgO. The mixing ratio of the raw materials was calculated so as to satisfy x=0.70, and y=2.0 in the aforementioned composition formula of ferrite, $Mg_xMn_{(1-x)}Fe_yO_4$.

When the particle size distribution of the raw materials in this slurry was measured to obtain D90, it was found that D90 was 0.87 μm, and it was confirmed that almost no rough particles of 1 μm or more existed in the raw materials. This slurry was jetted into hot air of about 130° C. by using the spray drier, to thereby obtain a dried granulated powder having particle size of 10 to 100 μm. Note that at this time, the granulated powders, with particle size exceeding 100 μm were removed by shifter. These granulated powders were charged into an electric furnace and sintered for 3 h at 1150° C. At this time, nitrogen gas was flown into the electric furnace, and the oxygen concentration in the furnace was set to be 0.2%. The obtained sintered materials were classified by using shifter after pulverization, to thereby obtain the carrier core material for electrophotographic developer of example 1, with the average particle size set to be 35 μm.

The XRD pattern of the obtained carrier core material for electrophotographic developer according to example 1 was measured and shown in table 1, and FIG. 1 and FIG. 2. Note that details of the measuring method will be described later.

Example 2

The carrier core material for electrophotographic developer of example 2, having average particle size 35 μm, was obtained in the same way as the example 1, other than a point that $Fe_2O_3$ was set to be 7.1 kg, $Mn_3O_4$ was set to be 2.4 kg, and MgO was set to be 0.5 kg.

The mixing ratio is expressed by the composition formula $Mg_xMn_{(1-x)}Fe_yO_4$ of the aforementioned ferrite wherein x=0.30 and y=2.0. Note that value D90 of the particle size distribution of the raw materials was 0.85 μm.

The XRD pattern of the obtained carrier core material for electrophotographic developer according to the example 2 was measured in the same way as the example 1, and shown in table 1 and FIG. 2.

Example 3

The carrier core material for electrophotographic developer of example 3, with average particle size set to be 35 μm, was obtained, in the same way as the example 1, other than a point that the atmosphere in the electric furnace was set in an atmospheric state and the oxygen concentration was set to be 21%.

The XRD pattern of the carrier core material for electrophotographic developer according to the example 3 was measured in the same way as the example 1, and shown in table 1 and FIG. 3.

Example 4

The carrier core material for electrophotographic developer according to example 4, with average particle size set to be 35 μm, was obtained in the same way as the example 3, other than a point that $Fe_2O_3$ was set to be 8.2 kg, $Mn_3O_4$ was set to be 0.4 kg, and MgO was set to be 1.5 kg.

The mixing ratio is expressed by the composition formula $Mg_xMn_{(1-x)}Fe_yO_4$ of the ferrite wherein x=0.89, and y=1.6. Note that value D90 of the particle size distribution of the raw materials was 0.85 μm.

The XRD pattern of the obtained carrier core material for electrophotographic developer according to example 5 was measured in the same way as the example 1, and shown in table 1 and FIG. 3.

Comparative Example 1

The obtained carrier core material for electrophotographic developer according to comparative example 1 was obtained, in the same way as the example 1, other than a point that no pulverization processing was performed to the slurry, becoming raw materials, by using the wet-type ball mill. Note that value D90 of the particle size distribution of the raw materials was 1.50 μm, and it was confirmed that rough particles exist in the slurry.

The XRD pattern of the obtained carrier core material for electrophotographic developer according to comparative example 1 was measured in the same way as the example 1, and shown in table 1 and FIG. 1.

Comparative Example 2

The carrier core material for electrophotographic developer according to comparative example 2, with average particle size set to be 35 μm, was obtained in the same way as the example 1, other than a point that $Fe_2O_3$ was set to be 6.8 kg, and $Mn_3O_4$ was set to be 3.2 kg.

The mixing ratio is expressed by the composition formula $Mg_xMn_{(1-x)}Fe_yO_4$ of the ferrite wherein x=0, and y=2.0. Note that value D90 of the particle size distribution of the raw materials was 0.88 μm.

The XRD pattern of the obtained carrier core material for electrophotographic developer according to comparative example 2 was measured in the same way as the example 1, and shown in table 1 and FIG. 2.

TABLE 1

| | Compositional Ratio | | Sintering atmosphere Oxygen | Raw material D90 | D50 | XRD Half-value | $\sigma_{1000}$ | Carrier |
|---|---|---|---|---|---|---|---|---|
| | x | y | concentration (%) | (μm) | (μm) | width | (emu/g) | scattering |
| Example1 | 0.70 | 2.0 | 0.20 | 0.87 | 34.8 | 0.137 | 46 | 1 |
| Example2 | 0.30 | 2.0 | 0.20 | 0.85 | 34.6 | 0.145 | 60 | 0.8 |
| Example3 | 0.70 | 2.0 | 21.0 | 0.87 | 35.1 | 0.157 | 40 | 1.2 |
| Example4 | 0.89 | 2.4 | 21.0 | 0.85 | 34.8 | 0.160 | 30 | 1.5 |
| Example5 | 0.73 | 1.6 | 21.0 | 0.88 | 34.5 | 0.167 | 28 | 1.6 |
| Comparative Example1 | 0.70 | 2.0 | 0.20 | 1.50 | 34.8 | 0.195 | 45 | 4.3 |
| Comparative Example2 | 0 | 2.0 | 0.20 | 0.88 | 35.4 | 0.186 | 71 | 5.2 |

The XRD pattern of the obtained carrier core material for electrophotographic developer according to the example 4, was measured in the same way as the example 1, and shown in table 1 and FIG. 3.

Example 5

The carrier core material for electrophotographic developer according to example 5, with average particle size set to be 35 μm, was obtained in the same way as the example 3, other than a point that $Fe_2O_3$ was set to be 7.2 kg, $Mn_3O_4$ was set to be 1.2 kg, and MgO was set to be 1.6 kg.

The mixing ratio is expressed by the composition formula $Mg_xMn_{(1-x)}Fe_yO_4$ of the ferrite wherein x=0.73, and y=1.6. Note that value D90 of the particle size distribution of the raw materials was 0.88 μm.

Conclusion of Examples 1 to 5, and Comparative Examples 1 and 2

The half-value width of a peak, being a maximum peak (311) of the powder XRD pattern, magnetic susceptibility, and carrier scattering amount, in the carrier core material for electrophotographic developer according to examples 1 to 5 and comparative examples 1 and 2, are shown in table 1. Note that the carrier scattering amount of the example 1 is standardized as "1", showing that the larger this value is, the more increased the carrier scattering amount is.

<Influence by the Raw Material Particle Size>

An influence given to the carrier scattering by the powder size of the raw materials will be examined from each XRD pattern.

A measurement result of the XRD pattern of the carrier core material for electrophotographic developer according to the example 1 and the comparative example 1 is shown in FIG. 1, for the purpose of examination. The measurement was performed when (2θ/θ) is a value between 41.00° and 41.75° where the peak having a maximum intensity appears.

It is found from FIG. 1, that rising of the peak having the maximum intensity is approximately the same between the example 1 and the comparative example 1, when viewed from the side of a lower angle. However, the peak of the comparative example 1 is broad in such a manner as being spread in the form of a skirt toward a higher angle side, compared with the peak of the example 1. Namely, the XRD pattern shows that there is a small existence ratio of the low magnetic susceptibility particles in the magnetic powders according to the example 1. Meanwhile, it can be considered that the magnetic powders of the comparative example 1 contain particles with deviated composition, namely, contains a plurality of low magnetic susceptibility particles.

Measurement results of the half-value widths in the XRD pattern of the carrier core material for electrophotographic developer according to the example 1 and the comparative example 1 indicate 0.137 and 0.195, respectively (these values are described in table 1)

Here, in the example 1 and the comparative example 1, the same mixing ratio of the raw materials and sintering conditions are the same. However, the raw material particle size is different between the example 1 and the comparative example 1. Particularly, value D90 of the particle size distribution of the example 1 is 1.0 μm or less, and it is found that the example 1 is manufactured under a condition that there are no rough raw material particles. From the data of the example 1 and the comparative example 1, it is found that the half-value width of the XRD peak having the maximum intensity is narrower, as the value D90 of the raw materials is smaller. As the value D90 is smaller, the half-value width becomes narrower, and this is because as a result of uniformly mixing the raw material powders by using fine raw materials, the existence ratio of the particles that deviate in composition is lowered. Accordingly, it can be considered that the ratio of the low magnetic susceptibility particles generated due to deviation in composition is also lowered.

The carrier scattering amount of the comparative example 1 is extremely increased, such as about five times the carrier of the example 1, corresponding to a level that causes a serious problem in the electrophotographic development. Accordingly, it is found that in order to suppress the carrier scattering for performing excellent electrophotographic development, it is necessary to use the carrier core material, with the half-value width of the XRD peak having the maximum intensity set to be 0.190 or less or preferably set to be 0.180 or less.

<Composition>

Next, examples 1 and 2, and the comparative example 2, in which the value of x is changed in the composition formula $Mg_xMn_{(1-x)}Fe_yO_4$ will be described. From FIG. 2, it is found that the value of x is increased, and as the composition ratio of Mg is increased, the position of the XRD peak is shifted toward the higher angle side. This is because ion radius of Mg is smaller than Mn ion radius.

Also, the half-value width of the carrier of the comparative example 2 corresponding to x=0 is increased. This shows that in the same way as described above, there are a plurality of particles, with composition deviated and magnetic susceptibility lowered.

These low magnetic susceptibility particles are generated as a result of causing oxidation of the carrier particles by oxygen that slightly exists in the furnace in the step of sintering. Meanwhile, it can be considered that the carrier particles of the example 1 and the example 2 having Mg in the ferrite and satisfying 0<x are prevented from being oxidized, and the low magnetic susceptibility particles are reduced. Values of the half-value widths of the carrier powders according to the examples 1 and 2, and comparative example 2 were respectively 0.137, 0.195, and 0.182 (these values are described in table 1).

From the result of table 1, it is found that the carrier powders of the example 1 and the example 2 having the composition formula $Mg_xMn_{(1-x)}Fe_yO_4$, wherein x=0.7 and 0.3, have narrow half-value widths and less carrier scattering amount. However, the carrier powders of the comparative example 2 satisfying x=0 has narrow half-value widths and extremely increased carrier scattering amount. This shows that when satisfying 0<x<1, the carrier capable of reducing the carrier scattering can be manufactured, without depending on the atmosphere during sintering.

The XRD pattern of the carrier particles according to examples 3 to 5 sintered in the atmospheric air is shown in FIG. 3. The position of the peak is slightly changed by the change of the values of x, y in the composition formula $Mg_xMn_{(1-x)}Fe_yO_4$. However, values of the half-value widths were not changed so much, and the values were respectively 0.157 (example 3), 0.160 (example 4), and 0.167 (example 5). Therefore, it was confirmed that the carrier powders have narrow half-value widths of the XRD pattern, even if sintering was performed in an atmosphere of higher oxygen partial pressure, than that of the examples 1, 2 and the comparative example 1.

From table 1, it was found that in each of the carrier powders according to the examples 1 to 5, the magnetic susceptibility ($\sigma_{1000}$)) was 15 emu/g or more and 65 emu/g or less. Accordingly, it was found that there were less particles of high magnetic susceptibility for excessively hardening the magnetic brush, in addition to the fact that there were less amount of the low magnetic susceptibility particles. Meanwhile, in a case of the carrier particles according to the comparative example 2 not containing Mg, the magnetic susceptibility ($\sigma_{1000}$) was 71 emu/g, and it was found that this was a level for excessively hardening the magnetic brush.

Particularly, in a case of the carrier powders according to the examples 3 to 5, in spite of the low magnetic susceptibility ($\sigma_{1000}$) such as 40 to 30 emu/g, the carrier scattering amount was about 1.5 times that of the example 1, corresponding to a level not problematic in practical use. This is because by adding Mg as described above, particles with extremely low magnetic susceptibility are reduced. Thus, it was confirmed that by the manufacturing method of the present invention, the carrier, with less low magnetic susceptibility particles and suppressed carrier scattering, could be manufactured.

By studying on the examples 1 to 5, and comparative examples 1 and 2 as described above, it was confirmed, that the carrier for electrophotographic developer excellent in image characteristics can be obtained, by reducing the carrier scattering, by using the carrier core material for electrophotographic developer, expressed by a general composition formula: $Mg_xMn_{(1-x)}Fe_yO_4$ (satisfying $0<x<1$, and $1.6\leq y\leq 2.4$), with half-value width B of the peak having the maximum intensity satisfying $B\leq 0.180$(degree) in the XRD pattern.

As described above, the measurement method of each characteristic value used in studying on the examples 1 to 5, and the comparative examples 1, 2, will be described below.

<Particle Size Distribution>

The particle size distribution of the raw materials and the carrier core material was measured by using Microtrac (produced by Nikkiso, Model: 9320-X100). From the obtained particle size distribution, 50 vol. %-cumulative particle size D50 and 90 vol. %-cumulative particle size D90 were calculated. Note that in the present invention, the value of this D50 was described as the average particle size of powders.

<Magnetic Characteristics>

Regarding the magnetic characteristics of the carrier core material, the magnetic susceptibility was measured by using VSM (produced by TOEI INDUSTRY Co., LTD. VSM-7), and magnetic susceptibility σ1000 (emu/g) in external magnetic field 1000 Oe was obtained.

<XRD Pattern>

The powder XRD pattern of the carrier core material was measured by using an X-Ray Diffractometer (produced by Rigaku, RINT2000). Cobalt was used in an X-ray source, to thereby generate X-ray, with acceleration voltage set to be 40 kV, and current set to be 30 mA. A diverging slit opening angle was ½°, a scattering slit opening angle was ½°, and a light receiving slit width was 0.15 mm. Measurement was performed by step scan, with measurement interval set to be 0.002°, count time set to be 5 seconds, and the number of integration set to be 3, to thereby perform accurate measurement of the half-value widths.

Calculation of the half-value widths was performed to the peak having the maximum intensity. This is because an influence of a noise is measured under few conditions. Further, although the peak with strong intensity appears on the lower angle side, the influence of the diffraction peak by Kα2 ray can be ignored toward the lower angle side, and therefore a result of a good reproducibility can be obtained. As a calculation method of the half-value widths, the width of the peak was measured at a part where the intensity was ½ of the maximum intensity of the peak.

Note that the carrier for electrophotographic developer was generally used, with the carrier core material coated with resin. However, the shape of the XRD pattern and the half-value width of the peak are not changed, because the X-ray transmits through the resin.

<Carrier Scattering>

Regarding the carrier scattering of the carrier core material, the carrier core material was filled into a magnetic drum having diameter 50 mm and surface magnetic force 1000 Gauss, then this magnetic drum was rotated at 270 rpm for 30 minutes, and thereafter scattered particles are recovered, and weights thereof were measured.

Figure 1:
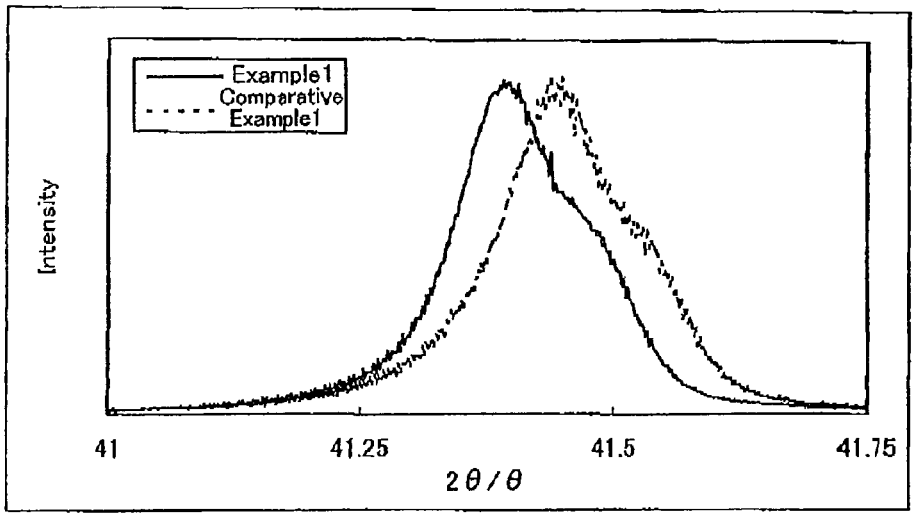
FIG. 1 is an XRD pattern of a carrier core material for electrophotographic developer according to the present invention.
Figure 2:
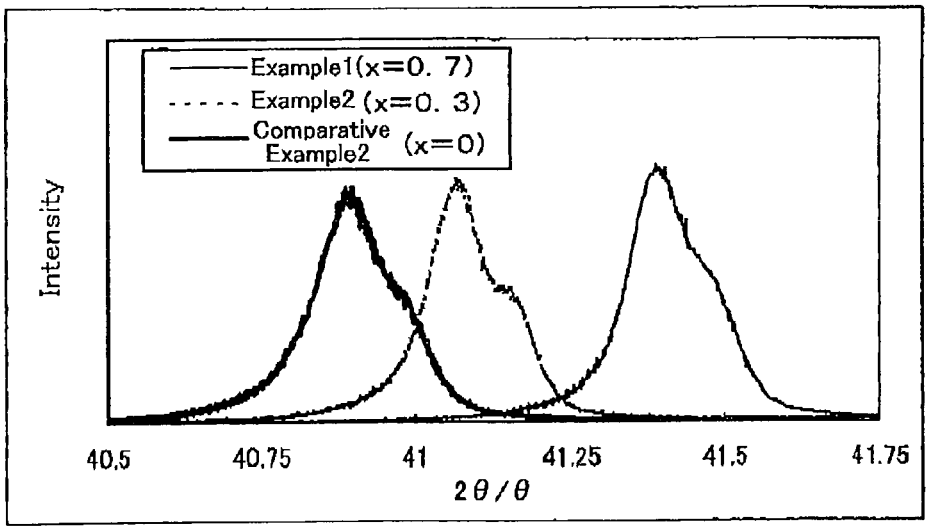
FIG. 2 is an XRD pattern of the carrier core material for electrophotographic developer according to the present invention.
Figure 3:
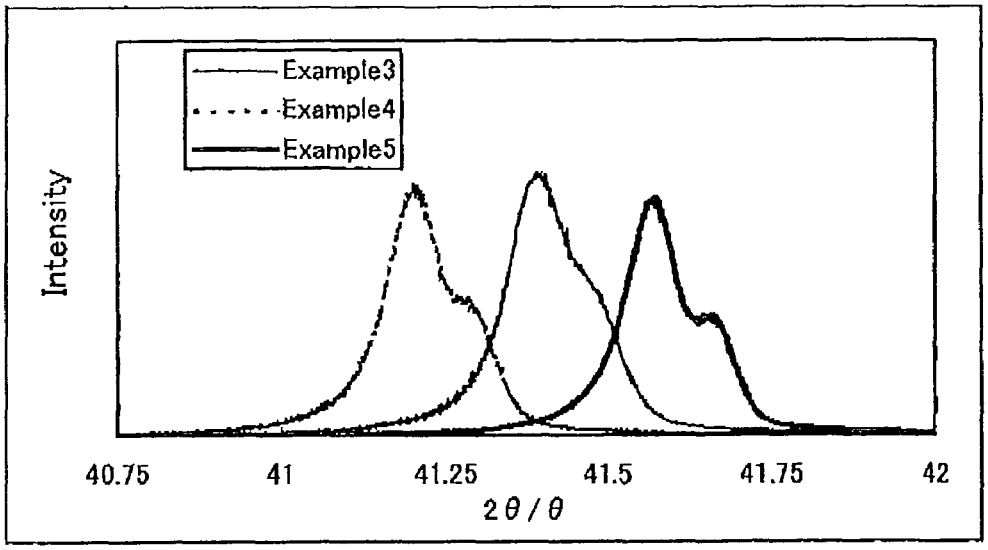
FIG. 3 is an XRD pattern of the carrier core material for electrophotographic developer according to the present invention.

What is claimed is:

1. A carrier core material for electrophotographic developer expressed by chemical formula $Mg_xMn_{(1-x)}Fe_yO_4$, where $0<x<1$, and $1.6\leq y\leq 2.4$ wherein a half-value width B of a peak having a maximum intensity in a powder XRD pattern, which is obtained by X-ray of Co-Kα, satisfies $B\leq 0.180$ (degree).

2. The carrier core material for electrophotographic developer according to claim 1, wherein the chemical formula is expressed by $Mg_xMn_{(1-x)}Fe_yO_4$, where $0<x\leq 0.8$, and $1.6\leq y\leq 2.4$.

3. The carrier core material for electrophotographic developer according to claim 1, wherein magnetic susceptibility $\sigma_{1000}$ of the carrier core material in an external magnetic field 10000*e* satisfies 15 emu/g$\leq\sigma_{1000}\leq$65 emu/g.

4. The carrier core material for electrophotographic developer according to claim 1, wherein an average particle size of the carrier core material is 10 μm or more and 80 μm or less.

5. A carrier for electrophotographic developer that is formed by coating the carrier core material according to claim 1 is coated with resin.

6. An electrophotographic developer that includes the carrier according to claim 5 and toner.

* * * * *